United States Patent [19]

Cerillo, Jr.

[11] 3,999,920

[45] Dec. 28, 1976

[54] COMBINED MORTAR DISPENSER AND JOINT STRIKER DEVICE

[76] Inventor: Patrick J. Cerillo, Jr., 800 George St., Plainfield, N.J. 07062

[22] Filed: June 20, 1975

[21] Appl. No.: 588,945

[52] U.S. Cl. ..... 425/447; 401/48

[51] Int. Cl.[2] ..... E04G 21/14

[58] Field of Search ..... 401/48, 193; 52/749; 222/561, 181, 185; 249/84, 95; 425/447

[56] References Cited

UNITED STATES PATENTS

| | | | |
|---|---|---|---|
| 2,683,981 | 7/1954 | Richey | 401/193 X |
| 3,162,886 | 12/1964 | Wise | 401/193 X |
| 3,325,960 | 6/1967 | James | 52/749 |
| 3,332,584 | 7/1967 | Pennington | 222/333 X |
| 3,350,833 | 11/1967 | Larger | 52/749 |
| 3,382,640 | 5/1968 | Thomas et al. | 52/749 |

*Primary Examiner*—Robert B. Reeves
*Assistant Examiner*—John P. Shannon
*Attorney, Agent, or Firm*—Cushman, Darby & Cushman

[57] ABSTRACT

A hopper for mortar is provided with a gate slidable between one position wherein mortar is free to flow downwardly and out of the device and another position wherein the gate blocks the hopper outlet. The flanking walls of the hopper are provided with adjustable supports for striker posts. In use to fill a vertical joint between ends of two adjacent masonry blocks, the supports are adjusted to slightly enter and fully cover the opposite sides of the joint. With the hopper in place over the joint, the gate is slid open and mortar is permitted to flow, until the space between the ends of the two blocks, and between the two striker posts is filled. Then the gate is slid closed. As the device is lifted straight upwards, the striker posts which preferably present convex surfaces toward the mortar, automatically tool the opposite sides of the joint. For use on the next joint of the same size, the device is slid downwards until it rests on the two blocks which adjoin such joint and the aforementioned filling and tooling is repeated.

6 Claims, 2 Drawing Figures

B3
28
30
32
22
24
34
20
28
35
28
B2
38
36
M
14
M
18
10
44
12
50
74
40
50
2
42
44
54
50
52
46
56
42
58
26
20
48
24
34
2
50
38
16
B3
M
J2
J1
B2
72
70
B1

COMBINED MORTAR DISPENSER AND JOINT STRIKER DEVICE

BACKGROUND OF THE INVENTION

The invention is in the field of devices for dispensing mortar and thus is useful in the laying of bricks to build brick walls or the like.

SUMMARY OF THE INVENTION

A hopper for mortar is provided with a gate slidable between one position wherein mortar is free to flow downwardly and out of the device and another position wherein the gate blocks the hopper outlet. The flanking walls of the hopper are provided wih adjustable supports for striker posts. In use to fill a vertical joint between ends of two adjacent masonry blocks, the supports are adjusted to slightly enter and fully cover the opposite sides of the joint. With the hopper in place over the joint, the gate is slid open and mortar is permitted to flow, until the space between the ends of the two blocks, and between the two striker posts is filled. Then the gate is slid closed. As the device is lifted straight upwards, the striker posts which preferably present convex surfaces toward the mortar, automatically tool the opposite sides of the joint. For use on the next joint of the same size, the device is slid downwards until it rests on the two blocks which adjoin such joint and the aforementioned filling and tooling is repeated.

Mortar is added to the hopper as needed. The device saves time for the mason by filling joints evenly and striking them at the same time to provide a clean and neat appearance.

The principles of the invention will be further discussed with reference to the drawing wherein a preferred embodiment is shown. The specifics illustrated in the drawing is intended to exemplify, rather than limit, aspects of the invention as defined in the claims.

BRIEF DESCRIPTION OF THE DRAWING

IN THE DRAWING

Figures 1, 2:
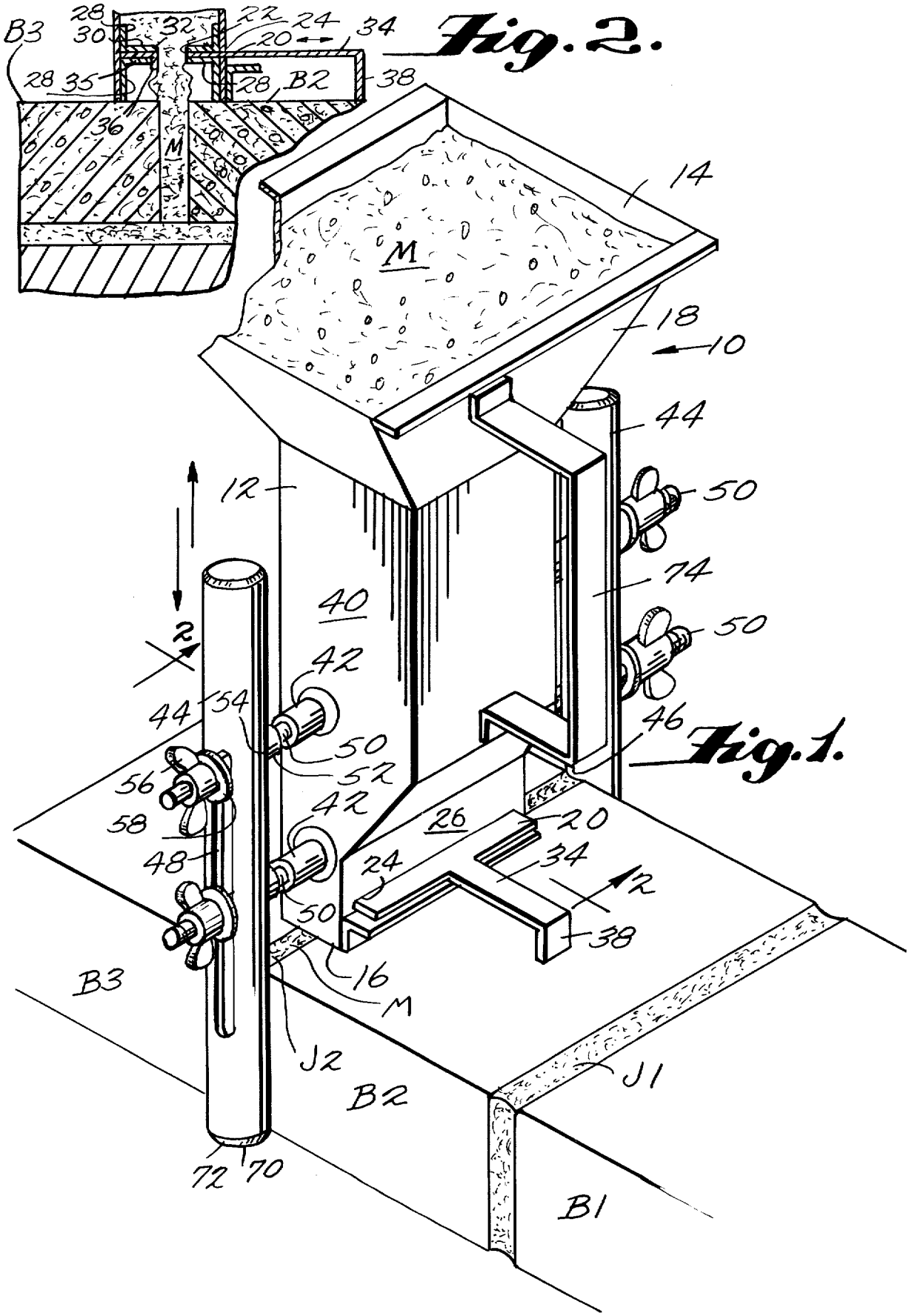

FIG. 1 is a perspective view of the combined mortar dispenser and joint striker device in a presently preferred embodiment; and FIG. 2 is a fragmentary vertical sectional view taken on line 2—2 of FIG. 1.

DETAILED DESCRIPTION

The device 10 includes a hopper body 12 constructed in the nature of a funnel, to have a larger, open, upwardly presented, receiving end 14 and a smaller open, downwardly presented dispensing end 16. Between the ends 14 and 16, where the hopper body undergoes a reduction in transverse cross-sectional area, the hopper sidewalls taper, as at 18.

Near the dispensing end, the hopper body is provided with a horizontally slidable shutter or gate 20 which has a slot 22 provided vertically therethrough. In this region, the hopper body is preferably of wide and thin, elongated rectangular transverse cross-sectional shape and the slot 22 is preferably of similar shape.

The gate 20 is slidingly received in the hopper body through a slit 24 in the sidewall 26. Supports 28 are provided on the sidewall to support the gate 20 for sliding movement. The supports 28 include a mask 30 having a slot 32. The gate 20 protrudes out through the slit 24 and is there provided with a handle 34 which may be pushed in and pulled out to slide the gate correspondingly. The slot 32 is so positioned and shaped, that when the handle 34 is pushed inwards the slot 22 is brought into vertical registry with the slot 32, allowing mortar M in the hopper to flow down through the slots 22 and 32 and out of the dispensing end 16 of the hopper body 12. Likewise, when the handle 34 is pulled outwards, the blind part 35 of the gate 20, located beside the slot 22 is brought into vertical registry with the slot 32, thus blocking the slot 32 and preventing the further dispensing of mortar. (It would be equivalent to construct the slide to be pulled out to open and pushed in to close.) The amount of handle 34 showing out through the slit 24 indicates to the user whether the gate is in an open or closed condition. However, to facilitate use, appropriate marks may be provided on the handle and/or stops, such as the stop 36 may be provided to limit gate movement to between the aforementioned two positions. If a stop 36 is provided, it may be made removable in order to permit disassembly of the device 10 for cleaning, adjustment or repair.

The hopper body 12 may be made to have its center of gravity displaced toward the sidewall through which the handle 34 projects, as shown. In that instance, the device 10 may be supported upon the hopper body dispensing end 16 and a tang or foot 38 caused to project down from the handle to the level of the end 16, for this purpose.

The two narrower sidewalls 40 of the hopper body 12 are provided with fittings 42 for mounting respective striker posts 44. In the instance shown, the posts 44 are vertically extending and of generally cylindrical transverse cross-sectional shape, at least to the extent of having generally cylindrically curved convex surfaces 46 presented towards the respective narrower sidewalls of the hopper body. Each post is shown including a vertically elongated slot 48 which receives two vertically spaced, horizontally extending exteriorly threaded rods 50 which have their respective bases secured in the fittings 42. Each rod 50 is shown provided with a first wing nut 52 and washer 54 between the respective post 44 and the respective narrow sidewall of the hopper body and a second wing nut 56 and washer 58 outboard of the respective post 44. Accordingly, the wing nuts 52, 56 may be threadably manipulated on the respective rods 50 to adjustably fix the lateral distance between the two striker posts 44, i.e., the proximity of the striker posts 44 to the sidewalls 40 and to one another.

In FIG. 1, a course of masonry blocks B1, B2, B3 is shown, at a stage where a joint J1 between two blocks B1 and B2 has been previously formed and a joint J2 between blocks B2 and B3 is being formed. (See FIG. 2.)

The preferred procedure for using the device 10 is as follows.

Two blocks B1 and B2 are set with their ends spaced by the desired length of the joint J1. The device 10 is rested on the blocks B1, B2 with its dispensing end 16 centered on the space where the joint J1 is to be formed. The proximity of the striker posts 44 is adjusted by moving the posts toward one another until the curved surface 46 of each engages the blocks B1, B2 at the perspective block ends and is thus cradled so that it slightly enters, and closes the ends of the space where the joint J1 is to be formed. These positions of the stiker posts 44 are then fixed by tightening the wing nuts 52, 56. (The slots 48 are preferably longer than the vertical spacing between the rods 50, so that the striker posts 44 also may be adjusted vertically when the wing nuts are loose. That permits the posts to be raised, when necessary, so that their lower ends 70 do not interfere with previously set lower courses of blocks. In fact, a shoulder 72 may be formed on each lower end 70, permitting the post to engage the upper surface of a respective edge of a lower course of block.)

Once the striker posts 44 are adjusted for the width of the blocks being set, and with the gate 20 closed, the hopper is filled with flowable joint filling composition, typically masonry mortar, portland cement concrete or the like, of the same composition and plastic consistency as is usually used by masons to fill such joint.

Then the handle 34 is moved to open the gate 20, whereupon mortar flows out of the hopper body end 16 to fill the space between the ends of the blocks and between the striker posts. When sufficient mortar has flowed, the handle is moved to close the gate. That cuts off the flow of mortar and isolates the downward pressure caused by the weight of mortar in the hopper from the mortar which has filled the joint. Next the device 10 is raised straight upwards until the striker posts 44 clear the joint. Any excess mortar lying on top of the blocks may be trowelled off. However, there is no need to strike the joint just made, because this is automatically done by the surfaces 46 of the striker posts 44 as the device 10 is raised. The block B3 is put in place. In practice, this may be done before the device 10 is raised from the joint J1, especially when the hopper center of gravity is displaced in the direction of the handle 34 as described above, and thus does not obstruct the site where block B3 is to be put in place. After the block B3 has been put in place, with an appropriate space provided between the ends of blocks B2 and B3 where the joint J2 is to be formed, the device 10 is lowered into place so that the striker posts blind the ends of the J2 joint space. The gate is then opened and the joint J2 made and automatically struck as described above with respect to the joint J2. Succeeding joints are made in the same way.

Materials and sizes for the device 10 may be varied. The device 10 may be made of metal, such as steel, protected by conventional composition or coating to perform satisfactorily in the presence of such corrosives as are found in mortar compositions. The device 10 may be made in one size for use with standard masonry block, in another size for use with conventional brick, and in other sizes. The adjustability of the striker posts does permit the device 10 of one size to be used with brick, block or the like (generally, "block") of varying sizes, so long as the block is not so narrow or wide that the striker posts cannot be properly adjusted to fit the ends of the joint spaces. In general, the device 10 can be expected to perform best when the width of the opening through the gate is not much shorter than the width of the blocks being joined so that the amount of lateral flow of mortar needed to fill the joint space is relatively small.

Various accessories may be provided to facilitate use of the device 10. For instance, the device 10 is shown provided with a hand grip 74 to facilitate lowering the device into place and for raising it to strike and clear a joint just formed.

It should now be apparent that the Combined Mortar Dispenser and Joint Striker Device as described hereinabove, possesses each of the attributes set forth in the specification under the heading "Summary of the Invention" hereinbefore. Because the Combined Mortar Dispenser and Joint Striker Device can be modified to some extent without departing from the principles of the invention as they have been outlined and explained in this specification, the present invention should be understood as encompassing all such modifications as are within the spirit and scope of the following claims.

What is claimed is:

1. A combined mortar dispenser and joint striker device for filling the joint space between the ends of two adjacent blocks in the same course, comprising:

bounding sidewall means defining a hopper body having an upwardly presented mortar receiving end and a downwardly presented mortar dispensing end;

means providing a shutter-like gate for the hopper body, shiftably disposed at least partly in the hopper body near the dispensing end, the gate being mounted for shifting between an open position wherein mortar may flow past the gate and downwardly out of the dispensing end of the hopper body, and a closed position wherein the gate closes off said flow of mortar;

handle means on the gate, positioned for accessibility from outside the hopper body, for shifting the gate between said two positions;

a pair of vertical striker posts positioned to engage said two adjacent blocks at the opposite sides of the adjacent ends of said blocks to close the sides of the joint space which is to be filled; and means mounting said striker posts on said hopper body in said position.

2. The device of claim 1, wherein:

said mounting means is adjustable to permit changing of the proximity of the striker posts to one another for accommodating use of the device with blocks of various widths.

3. The device of claim 1, wherein:

said mounting means is adjustable to permit changing the level of the lower extents of the striker posts to avoid interference with any structures below said course of blocks.

4. The device of claim 1, wherein:

the striker posts include a generally cylindrically curved, convex surface presented one toward the other, so that as the device is raised from a joint filled thereby, the two respective outer vertical surfaces of that joint are automatically struck to concave transverse profile.

5. The device of claim 1, wherein:

the hopper body sidewall means is provided with opening means defining a slit through which said gate protrudes;

the gate handle means being provided thereon outwardly of said slit, for push-pull operation to slide the gate beteen said two positions.

6. The device of claim 5, wherein:

the gate handle means is provided with a tang which projects downwards, to the level of the mortar dispensing end of the hopper body; the hopper body including an upper portion which extends laterally further in the same direction that the gate handle means protrudes than said portion extends in the opposite direction, so that, when filled with mortar, the weight of the device rests upon the dispensing end of the hopper body and upon the tang of the handle means.

* * * * *